US012565894B2

(12) United States Patent
Dare et al.

(10) Patent No.: US 12,565,894 B2
(45) Date of Patent: Mar. 3, 2026

(54) VENTILATION SYSTEM WITH INTEGRATED DRIVE SYSTEM

(71) Applicant: Broan-NuTone LLC, Hartford, WI (US)

(72) Inventors: Tom Dare, Hartford, WI (US); Santosh Narasimhan, Hartford, WI (US)

(73) Assignee: Broan-NuTone LLC, Hartford, WI (US)

( * ) Notice: Subject to any disclaimer, the term of this patent is extended or adjusted under 35 U.S.C. 154(b) by 123 days.

(21) Appl. No.: 18/463,356

(22) Filed: Sep. 8, 2023

(65) Prior Publication Data

US 2024/0084809 A1 Mar. 14, 2024

Related U.S. Application Data

(60) Provisional application No. 63/405,527, filed on Sep. 12, 2022.

(51) Int. Cl.
*F04D 25/06* (2006.01)
*F04D 17/16* (2006.01)

(52) U.S. Cl.
CPC ..... *F04D 25/06* (2013.01); *F04D 17/16* (2013.01)

(58) Field of Classification Search
CPC ..... F04D 17/16; F04D 25/0606; F04D 25/06; F04D 25/066
See application file for complete search history.

(56) References Cited

U.S. PATENT DOCUMENTS

| | | | | |
|---|---|---|---|---|
| 5,814,908 | A * | 9/1998 | Muszynski | F04D 29/5806 310/58 |
| 9,143,023 | B1 * | 9/2015 | Uskert | H02K 99/20 |
| 9,945,580 | B2 * | 4/2018 | Penlesky | F24F 13/32 |
| 2002/0021973 | A1 * | 2/2002 | Nelson | H02K 41/03 417/355 |
| 2004/0042916 | A1 * | 3/2004 | Masterton | F04D 25/066 417/423.7 |

* cited by examiner

*Primary Examiner* — Kenneth J Hansen
(74) *Attorney, Agent, or Firm* — Hansen Reynolds LLC

(57) ABSTRACT

A ventilating fan has a fan housing formed to define an interior space, an inlet opening, and an outlet opening spaced apart from the inlet opening, a fan wheel arranged to lie within the interior space, the fan wheel comprising a blade hub and a plurality of fan blades from the blade hub, and a fan-wheel rotation drive assembly configured to rotate the plurality of fan blades about a rotation axis, the fan-wheel rotation drive assembly comprising one or more rotor magnets fixed to the fan wheel and arranged circumferentially around the rotation axis, and one or more stator magnets fixed to the fan housing and arranged circumferentially around the rotation axis.

14 Claims, 11 Drawing Sheets

VENTILATION SYSTEM WITH INTEGRATED DRIVE SYSTEM

PRIORITY CLAIM

This application claims priority to U.S. provisional application 63/405,527 filed on Sep. 12, 2022, which is incorporated by reference herein in its entirety.

BACKGROUND

Conventional ventilation fans incorporate an electric motor preconfigured within a dedicated motor housing for rotating a fan wheel. The present disclosure relates to a ventilation fan without the dedicated motor housing.

SUMMARY

The present disclosure relates to placing the rotor and stator magnets within a ventilation fan without the dedicated motor housing and locating the rotor and stator magnets to drive rotation of the fan wheel. This allows distribution of the rotor and stator magnets, as well as other components of an electric motor, in various portions of the ventilation fan to drive rotation of the fan wheel to improve airflow, which increases drive power efficiency and reduces noise created by the motor and the air flow.

According to the present disclosure, a ventilating fan has a fan housing formed to define an interior space, an inlet opening, and an outlet opening spaced apart from the inlet opening, a fan wheel arranged to lie within the interior space, the fan wheel comprising a blade hub and a plurality of fan blades from the blade hub, and a fan-wheel rotation drive assembly configured to rotate the plurality of fan blades about a rotation axis, the fan-wheel rotation drive assembly comprising one or more rotor magnets fixed to the fan wheel and arranged circumferentially around the rotation axis, and one or more stator magnets fixed to the fan housing and arranged circumferentially around the rotation axis. The ventilation fan may have a controller coupled to each of stator magnets and configured to energize the plurality of stator magnets and produce a magnetic field to cause magnetic interaction with at least one of the plurality of rotor magnets so that the plurality of rotor magnets and the plurality of fan blades rotate about the rotation axis. The blower wheel may have a support ring secured to the fan blades and the one or more rotor magnets are secured to the support ring. The fan blades define a first end extending from the blade hub and a second end opposing the first end, and the blower support ring touches at least one fan blade second end. One or more of the fan blades can define a first end extending from the blade hub and a second end opposing the first end, and the blower support ring is mounted to the second end of at least one fan blade. The support ring defines (i) an inner surface and an outer surface defining a thickness T, and (ii) an top edge and a bottom edge defining a height H, and the fan blade second end of one or more of the fan blades may lies along the height H of the support ring. The support ring may be secured to the second end of one of the one or more fan blades and extend further away from the hub from the fan blade second end. The ventilation fan can have a stator magnet frame to which the one or more stator magnets are secured. The stator magnet frame may be secured to the fan housing. The stator magnet frame may extend about the rotor magnets on the fan wheel. The stator magnet frame may extend less than 360 degrees about the rotation axis. The stator magnet frame may extend 90 degrees about the rotation axis.

According to another aspect of the disclosure, a ventilation fan has a fan housing defining an interior space, at least one stator magnet connected to the fan housing, a fan wheel located within the interior space, at least one rotor magnet connected to the fan wheel, and at least one of the stator magnet and the rotor magnet is an electromagnet configured to produce a magnetic field to cause the other of the stator magnet and the rotor magnet to move. The fan wheel may be configured to rotate about a rotation axis within the fan housing and the at least one stator magnet may be connected to the fan wheel, which is configured to rotate about the rotation axis with the fan wheel. The ventilation fan may also have a stator magnet frame to which the at least one stator magnet is secured. The stator magnet frame may extend about the at least one rotor magnet on the fan wheel. The stator magnet frame may extend less than 360 degrees about the rotation axis. The stator magnet frame may extend 90 degrees about the rotation axis.

According to yet another aspect of the disclosure, a ventilation fan has a fan housing defining an interior space, a fan wheel arranged within the interior space and defining a rotation axis, one or more rotor magnets fixed to the fan wheel and arranged circumferentially around the rotation axis, and one or more stator magnets fixed to the fan housing and arranged to extend circumferentially around the rotation axis less than 360 degree.

Additional features of the present disclosure will become apparent to those skilled in the art upon consideration of illustrative embodiments exemplifying the best mode of carrying out the disclosure as presently perceived.

BRIEF DESCRIPTIONS OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

Figure 1:
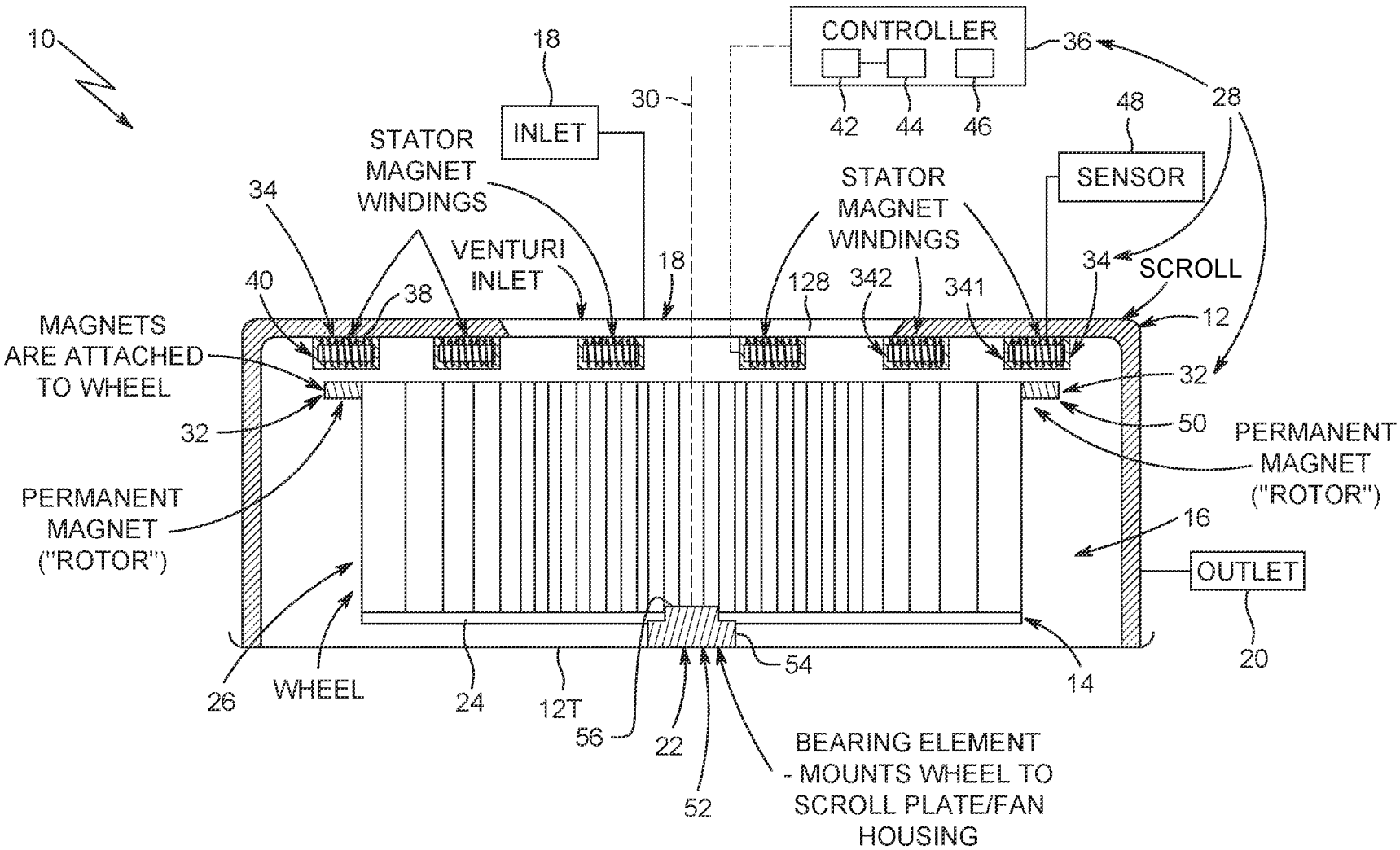
FIG. 1 is a cross-sectional view of an exemplary ventilation fan of the present disclosure.

A ventilation fan 10 is configured to be mounted to a building and is configured to ventilate at least one room of the building. The ventilation fan 10 includes a fan housing (alternatively called a scroll) 12 and a fan wheel 14 arranged to lie within an interior space 16 defined by the fan housing 12 as shown in FIG. 1. The fan housing 12 is also formed to include an inlet 18 opening into the interior space 16 and an outlet 20 opening into the interior space 16 and spaced apart from the inlet 18.

The fan wheel 14 is coupled to the fan housing 12 and is configured to displace air through the inlet 18 and into the interior space 16. The air is then expelled through the outlet 20 and is transported away from the ventilation fan 10 by a duct, for example. In one example, the ventilation fan 10 is mounted above a ceiling of the building and is configured to withdraw air from the at least one room through an opening in the ceiling. The withdrawn air may be exhausted to an exterior of the building.

Figure 2:
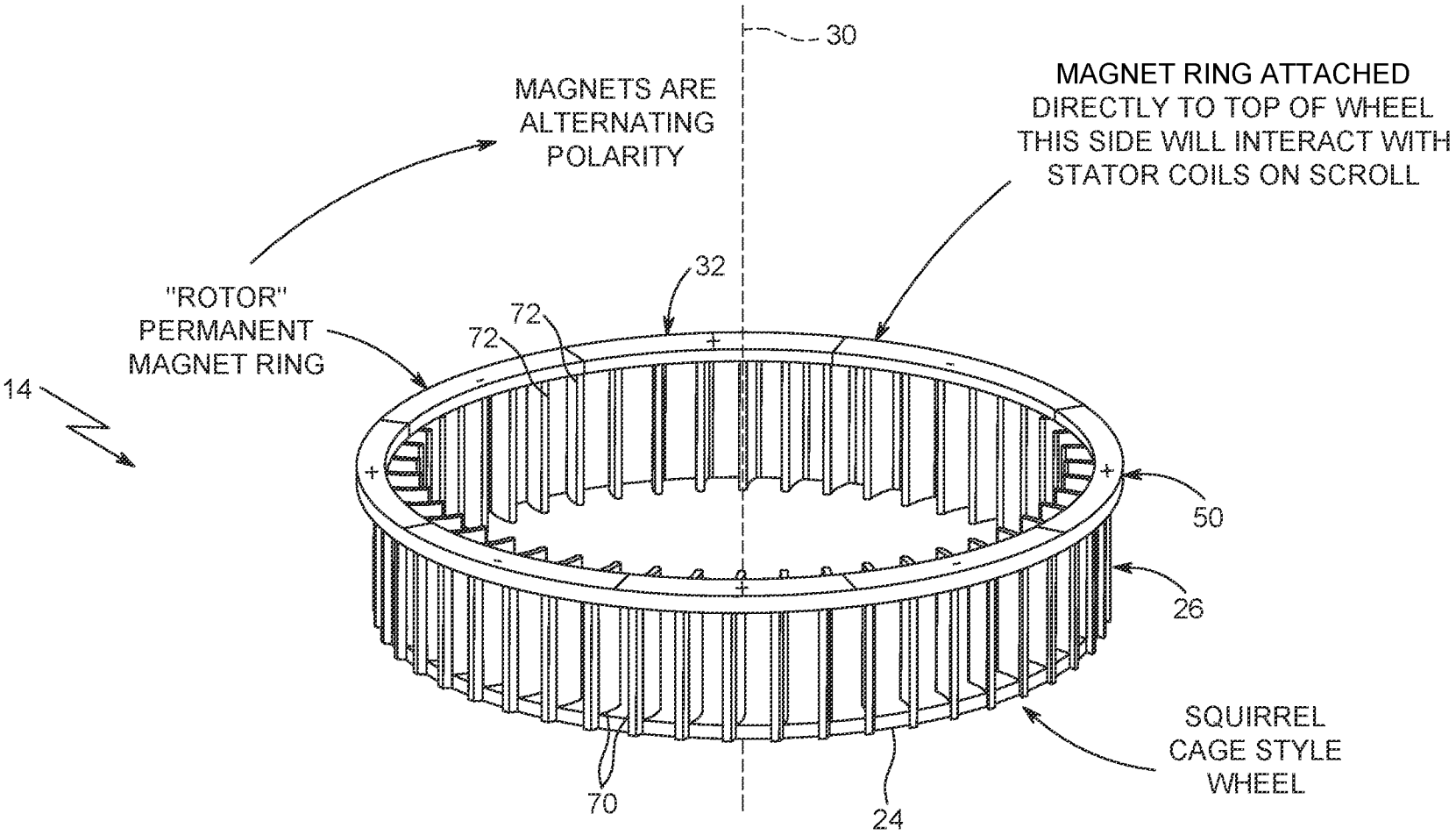
FIG. 2 is a perspective view of a fan wheel of the ventilation fan of FIG. 1.
Figure 3:
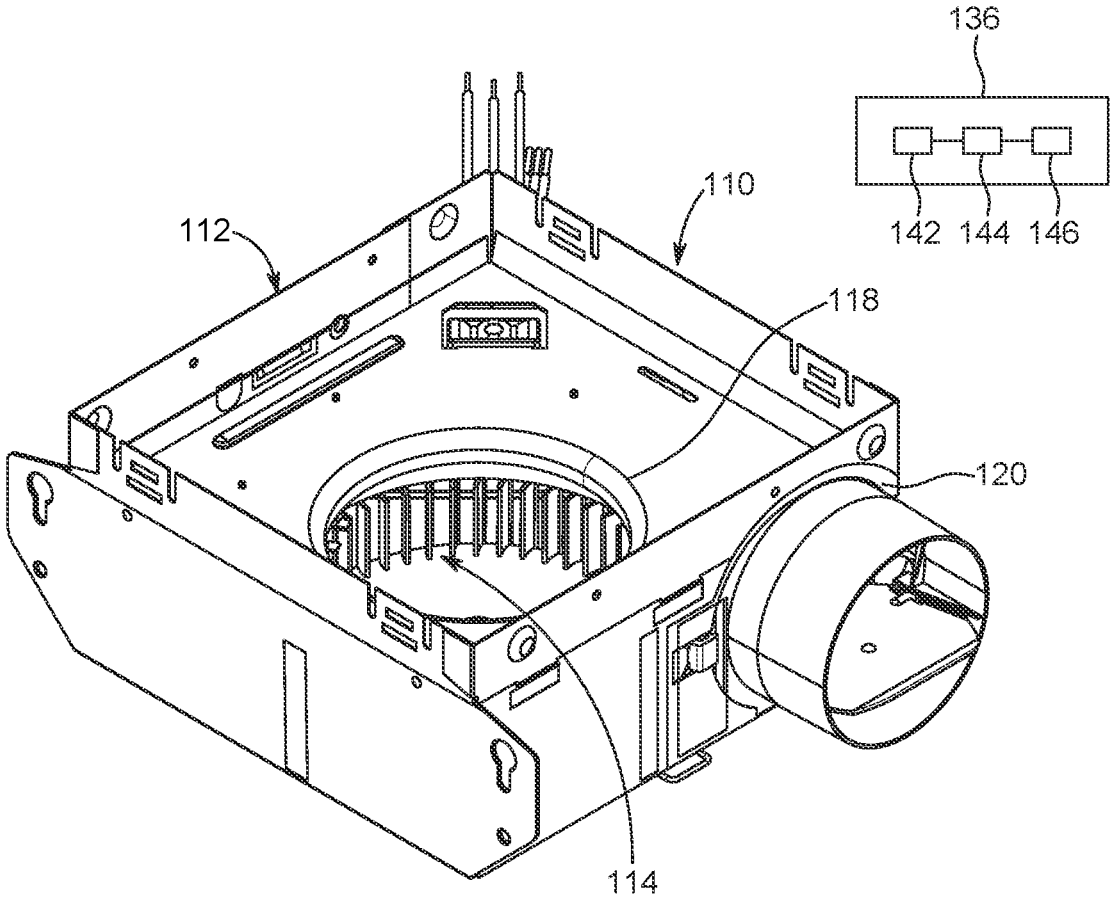
FIG. 3 is a perspective view of another exemplary ventilation fan of the present disclosure.
Figure 4:
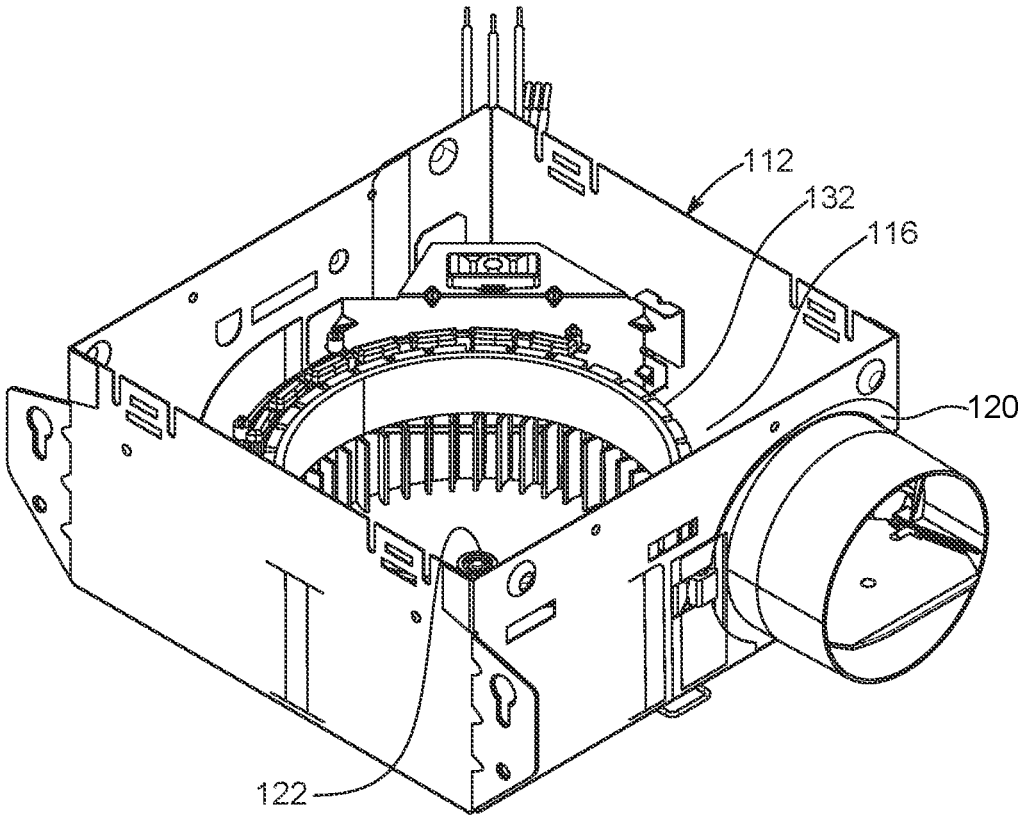
FIG. 4 is a perspective view of the ventilation fan of FIG. 3 with portions of the fan housing removed.
Figure 5:
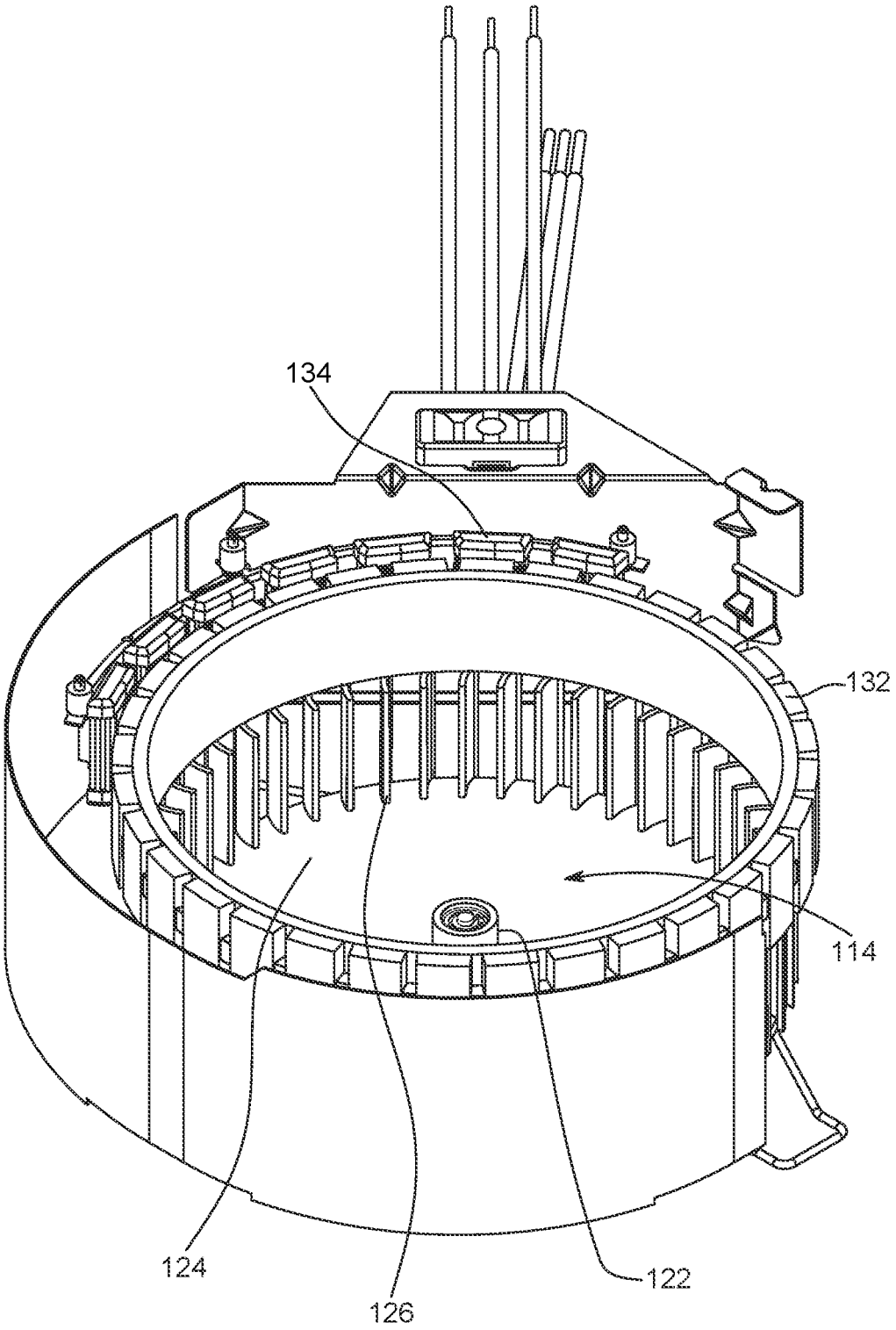
FIG. 5 is a perspective view of the fan wheel and a rotation drive assembly of the ventilation fan of FIG. 3.
Figure 6:
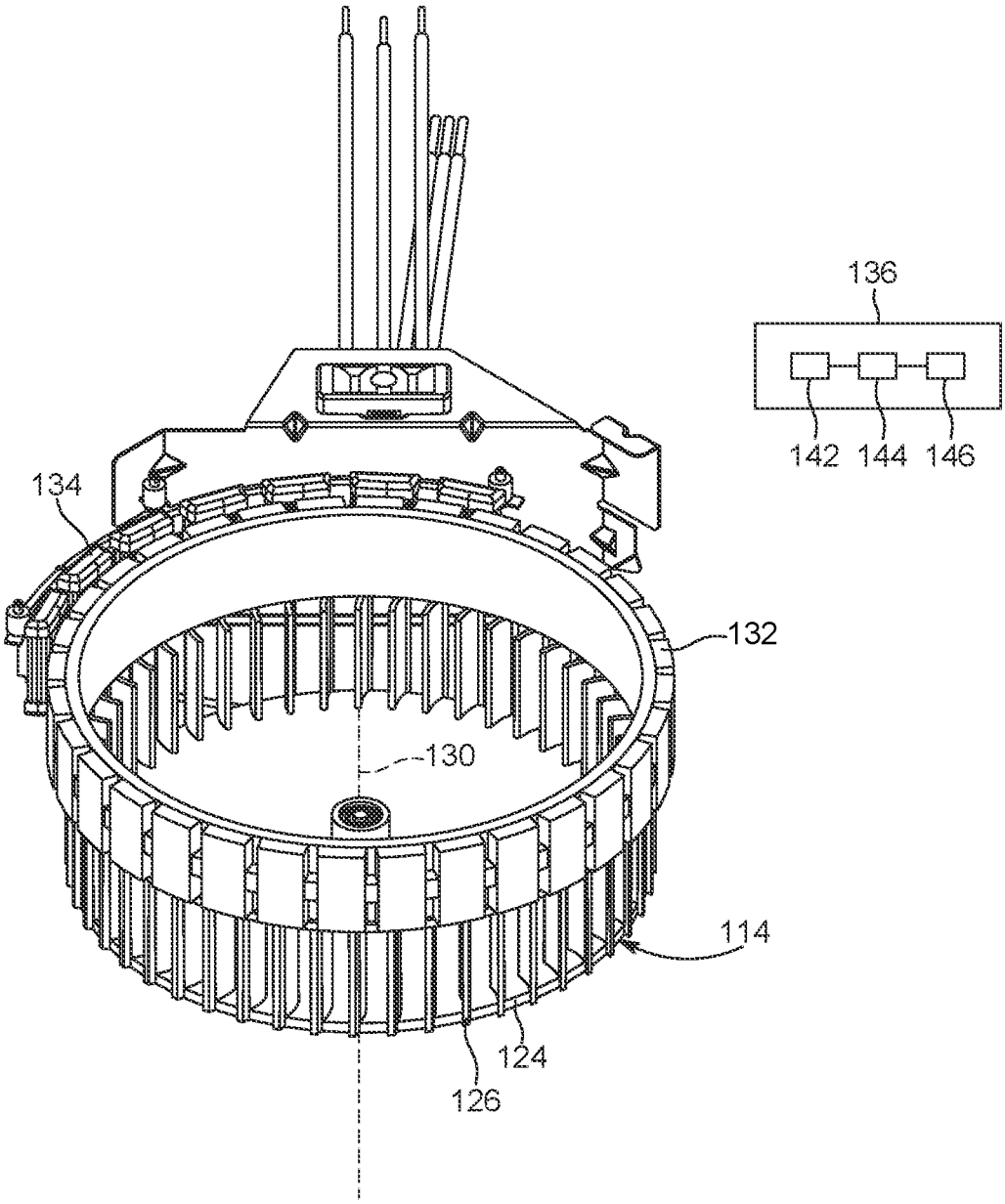
FIG. 6 is another perspective view of the fan wheel and the rotation drive assembly of the ventilation fan of FIG. 3.
Figure 7:
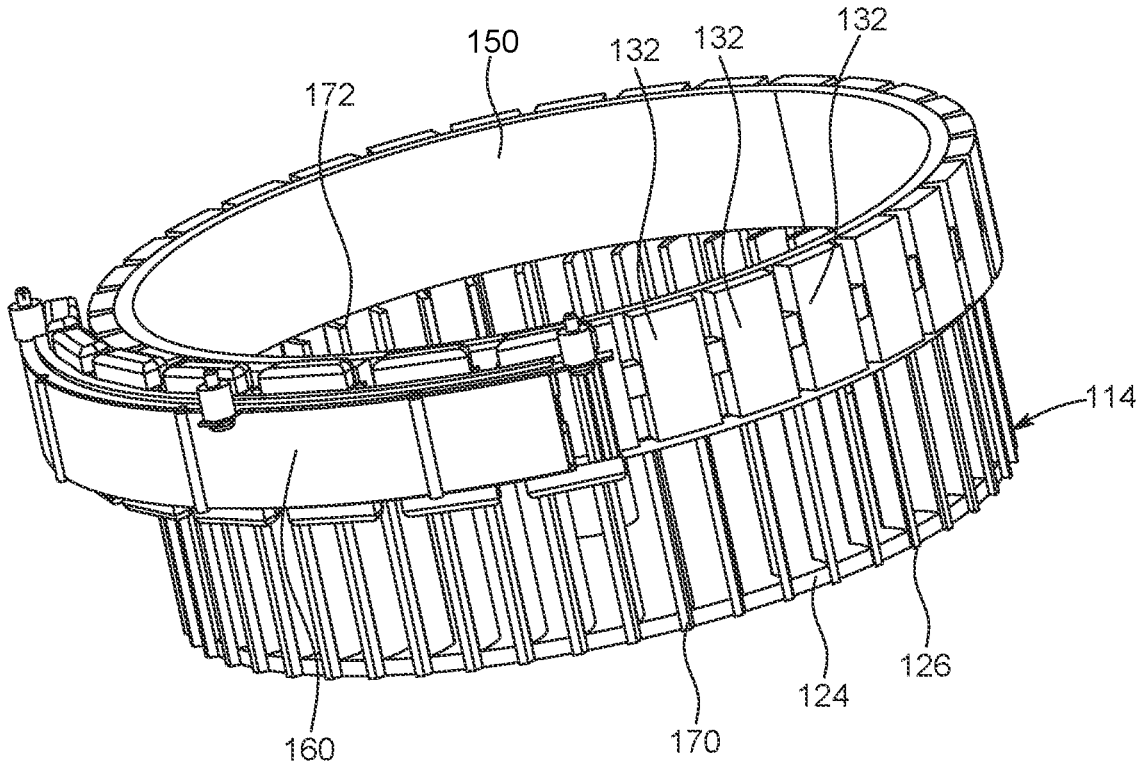
FIG. 7 is yet another a perspective view of the fan wheel and rotation drive assembly of the ventilation fan of FIG. 3.

The fan wheel 14 includes a wheel mount 22 coupled to the fan housing 12, a blade hub 24 coupled to the wheel mount 22, and a plurality of fan blades 26 coupled to the blade hub 24 as shown in FIGS. 1 and 2. The wheel mount 22 is fixed to a top wall 12T of the fan housing in the illustrative embodiment, however, in other embodiments, the wheel mount 22 can be coupled to other parts of the fan housing 12. The blade hub 24 is arranged to lie within the interior space 16 and is spaced apart from the top wall 12T. The plurality of fan blades 26 are also arranged to lie within the interior space 16 and extend away from the blade hub 24.

In the illustrative embodiment, the ventilation fan 10 further includes a fan-wheel rotation drive assembly 28 configured to rotate the blade hub 2 and the plurality of fan blades 26 about a rotation axis 30 as shown in FIGS. 1 and 2. The fan-wheel rotation drive assembly 28 includes a plurality of rotor magnets 32, a plurality of stator magnets 34, and a controller 36. The plurality of rotor magnets 32 are fixed to the fan wheel 14 and are arranged circumferentially around the rotation axis 30. The plurality of stator magnets 34 are fixed to the fan housing 12 and are also arranged circumferentially around the rotation axis 30 and aligned with the plurality of rotor magnets 32. The controller 36 is coupled electrically to each of stator magnets 34. The controller 36 is configured to output signals and/or power to the plurality of stator magnets 34 to cause the plurality of stator magnets 34 to interact with the plurality of rotor magnets 32 so as to rotate the plurality of rotor magnets 32 about the rotation axis 30. Since the plurality of rotor magnets 32 are fixed to the fan wheel 14, the fan wheel 14, including the plurality of fan blades 26, is driven to rotate about the rotation axis 30 with the plurality of rotor magnets 32. It should be appreciated that, in some embodiments, the plurality of rotor magnets 32 may be fixed to the fan housing 12 and the plurality of stator magnets 34 may be fixed to the fan wheel 14.

In the illustrative embodiment, the plurality of rotor magnets 32 are permanent magnets and retain their magnetic properties in the absence of an inducing field or current. Each magnet 32 has a north pole and a south pole. The magnets are arranged so that each north and south pole faces in the same direction. Thus, each north pole is arranged to lie circumferentially between the south pole of the same magnet 32 and a south pole of a neighboring magnet 32. Likewise, each south pole is arranged to lie circumferentially between the north pole of the same magnet and a north pole of a neighboring magnet 32.

Each of the plurality of stator magnets 34 are each embodied as an electromagnet and include a metallic core 38 and a wire coil 40 wrapped around the metallic core 38 as shown in FIG. 1. Each wire coil 40 is connected to the controller 36 and is configured to receive electrical power therefrom.

The controller 36 is configured to energize the plurality of stator magnets 34 so that at least one of the plurality of stator magnets 34 produces a magnetic field. The magnetic field produced by the at least one stator magnet 34 interacts with the magnetic field of at least one of the plurality of rotor magnets 32. This interaction causes the plurality of rotor magnets 32 and the plurality of fan blades 26 to rotate about the rotation axis 30 relative to the plurality of stator magnets 34 and the fan housing 12.

The plurality of stator magnets 34 may be energized by the controller 36 consecutively to cause continuous rotation of the plurality of rotor magnets 32 and the plurality of fan blades 26 about the rotation axis 30. For example, a first stator magnet 341 may be energized by the controller 36 while the other stator magnets 34 are not energized. The first stator magnet 34 may push or pull one or more of the rotor magnets 32 to drive rotation of the fan wheel 14. The controller 36 stops energizing the first stator magnet 341 once the rotor magnets 32 have rotated to a point where the first stator magnet 341 is no longer pushing or pulling one or more of the rotor magnets 32. The controller may then energize a second stator magnet 342 to continue pushing or pulling one or more of the rotor magnets 32. This sequence repeats to energize each of the stator magnets 34 in series as the rotor magnets 32 continue rotating about rotation axis 30 to continuously push or pull one or more rotor magnets 32 so that the fan wheel 14, including the plurality of fan blades 26, continue to rotate about the rotation axis 30. Multiple stator magnets 34 may be energized at the same time to apply a pushing or pulling force on different rotor magnets 32.

The controller 36 includes a processor 42, a memory storage device 44, and a power source 46 as shown in FIG. 1. The memory storage device 44 stores instructions that, when executed by the processor 42, cause the power source 46 to send electrical power to one or more of the stator magnets 34. The processor 42 is configured to synchronize when electrical power is supplied from the power source 46 to each of the stator magnets 34. A sensor 48 may be used to determine the location of the rotor magnets 32 relative to the stator magnets 34 and provide signals to the controller 36 so that the controller 36 is able to determine which of the stator magnets 34 to energize. The sensor 48 may be a Hall sensor or any other suitable sensor that is able to determine the location of the rotor magnets 32 relative to the stator magnets 34.

The fan wheel 14 in the illustrative embodiment is a squirrel-cage type fan wheel. Each of the fan blades 26 extends away from the blade hub 24 generally in the same direction as the rotation axis 30. Each of the fan blades 26 has a first end 70 fixed to the blade hub 24 and an opposite, second end 72 spaced apart from the blade hub 24. The fan wheel 14 may further include a support ring 50 coupled to the second end 72 of each of the fan blades 26. In other embodiments, a different fan blade arrangement may be used such as blades that extend radially outward away from the blade hub 24 and the rotation axis 30.

The plurality of rotor magnets 32 are fixed to the support ring 50 in the illustrative embodiment. Both the rotor magnets 32 and the support ring 50 extend radially outward away from the second end of each of the fan blades 26. Each of the stator magnets 34 is coupled to a bottom wall 12B of the fan housing 12. The plurality of rotor magnets 32 and the plurality of stator magnets 34 are located generally equidistant to the rotation axis 30 such that the plurality of stator magnets 34 are directly above or below the plurality of rotor magnets 32.

In other embodiments, the plurality of rotor magnets 32 and the plurality of stator magnets 34 may be in different positions relative to one another and relative to the fan housing 12. For example, in another embodiment, the plurality of stator magnets 34 may be coupled to side walls of the fan housing 12 to be positioned radially outward from each of the plurality of rotor magnets 32 as shown and described in the embodiment of FIGS. 3-11. In another embodiment, the plurality of rotor magnets 32 are coupled to the blade hub 24 at or near the first end of the fan blades 26 and the plurality of stator magnets 34 are coupled to the top wall 12T of the fan housing 12.

The wheel mount 22 is a bearing 52 to allow free rotation of the fan wheel 14 relative to the fan housing 12 as shown in FIG. 1. The bearing 52 includes a stator 54 and a rotor 56. The stator 54 is fixed to the fan housing 12 while the rotor 56 is fixed to the blade hub 24 and movable relative to the stator 54 about axis 30.

The fan-wheel rotation drive assembly 28 provides several advantages over other devices that rotated fan blades in other comparable ventilation fans. For example, the fan-wheel rotation drive assembly 28 replaces an electrical motor which is used in the other comparable ventilation fans. Thus, space needed to accommodate an electric motor is saved and the size of the fan housing 12 and interior space 16 can be reduced. The ventilation fan 10 can be located in attic spaces with lower clearance than other comparable fans that use an electric motor. Electric motors tend to produce noise during operation. Thus, the fan-wheel rotation drive assembly 28 will reduce noise compared to other ventilation fans. The fan-wheel rotation drive assembly 28 may also be more efficient than electric motors since there is reduced friction in the fan-wheel rotation drive assembly 28 with the use of rotor magnets 32 and stator magnets 34.

FIGS. 3-11 depict another exemplary embodiment of the ventilation fan of the present disclosure. More particularly, FIGS. 3-11 depict a ventilation fan 110 having a fan housing 112 defining an interior space 116 in which a fan wheel 114 resides. The fan housing 112 defines an inlet 118 through which air may be drawn into the fan housing 112 and an outlet 120 through which air may be expelled from the fan housing 112. The fan wheel 114 has a hub 124 releasably secured to a wheel mount (not depicted), as described above, for rotatably mounting the fan wheel 114 to the fan housing 112 and a plurality of fan blades 126 extending from the hub 124 parallel to an axis of rotation 130 of the fan wheel 114. Each of the plurality of fan blades 126 defines a first end 170 at the fan wheel hub 124 and a second end 172 separated from, and opposing, the first end 170 to define a fan blade length L. The cross-sectional profile of the fan blades 126 are defined as an airfoil to facilitate movement of air outwardly from the rotational axis 130 when the fan wheel 114 is rotated about the rotation axis 130. The cross-sectional profile of the fan blades 126 can be uniform along the length L of the fan blades 126 or can vary along the length L of the fan blades 126 as needed to optimize air movement, power consumption and noise generation.

A support ring 150 is situated at the top of the fan wheel 114. The support ring defines an inner surface 150*a* and an outer surface 150*b*, defining a thickness T1 therebetween, as well as a top edge 150*c* separated from a bottom edge 150*d* to define a height H1 of the support ring 150 therebetween. In the depicted embodiment, the support ring inner surface 150*a* is circular to define an inner diameter of the support ring 150 and the support ring outer surface 150*b* is circular to define an outer diameter of the support ring 150. The support ring 150 is depicted as being located with the bottom edge 150*b* at the second end 172 of the fan blades 126 and extending upward therefrom away from the hub 124. In this embodiment, the support ring bottom edge 150*b* is secured to the fan blades 126 at, or near, the second end 172. The support ring 150 is depicted as being secured to less than all of the second end 172 of each fan blade 114, extending only a portion of the distance between the fan blade outer edges 174 to the fan blade inner edges 176. In some embodiments, the support ring 150 extends across the entire fan blade second end 172. In some embodiments, the support ring 150 may be secured to less than all fan blades 126, so long as sufficient structural rigidity exists to rotate the fan wheel 114 when the support ring 150 is driven. In some embodiments, the support ring inner surface 150*a* is secured to the fan blade outer edges 174, which extend along some or all of the support ring inner surface 150*a*.

In the depicted embodiment, the support ring 150 is comprised of a single piece of material extending 360 degrees about the rotation axis 130. In other embodiments, the support ring 150 is comprised of a plurality of pieces of material extending 360 degrees about the rotation axis 130 and connected to one another or only connected to the fan blades 126. Other embodiments comprise a support ring (not depicted) that comprises one or more pieces that together extends less than 360 degrees about the rotation axis 130.

The ventilation fan 110 includes a fan-wheel rotation drive assembly 128 includes one or more rotor magnets 132, one or more stator magnets 134, and a controller 136. The one or more rotor magnets 132 are located on the support ring outer surface 150*b* circumferentially about the rotation axis 130, consistent with the discussions above. The number of the rotor magnets 132 and their size can vary depending on the magnitude of the circumference of the supporting ring outer surface 150*b* and the magnitude of the power to be delivered by the fan-wheel rotation drive assembly 128 to the fan wheel 114. The one or more stator magnets 134 are fixed to the fan housing 112 and are also arranged circumferentially around the rotation axis 130 and aligned with and spaced from the plurality of rotor magnets 132 to create a gap therebetween allowing free rotation of the fan wheel 114 while optimizing rotational power derived from the rotor magnets 132 and the stator magnet 134. The number of the stator magnets 134 and their size can vary depending on the magnitude of the circumference of the supporting ring outer surface 150*b* and the magnitude of the power to be delivered by the fan-wheel rotation drive assembly 128 to the fan wheel 114. In one exemplary embodiment, the rotor magnets 132 have a thickness of 0.234 inches, the stator magnets 134, including windings, have a thickness of 0.20 inches and the gap between the magnets is 0.020 inches. Other sizes and dimensions are contemplated.

The controller 136 is coupled electrically to the one or more stator magnets 134. The controller 136 is configured to output signals and/or power to the one or more stator magnets 134 to cause the one or more stator magnets 134 to interact with the one or more rotor magnets 132 so as to drive rotation of the one or more rotor magnets 132 about the rotation axis 130, driving rotation of the fan wheel 114, including the plurality of fan blades 126, about the rotation axis 130.

Figure 8:
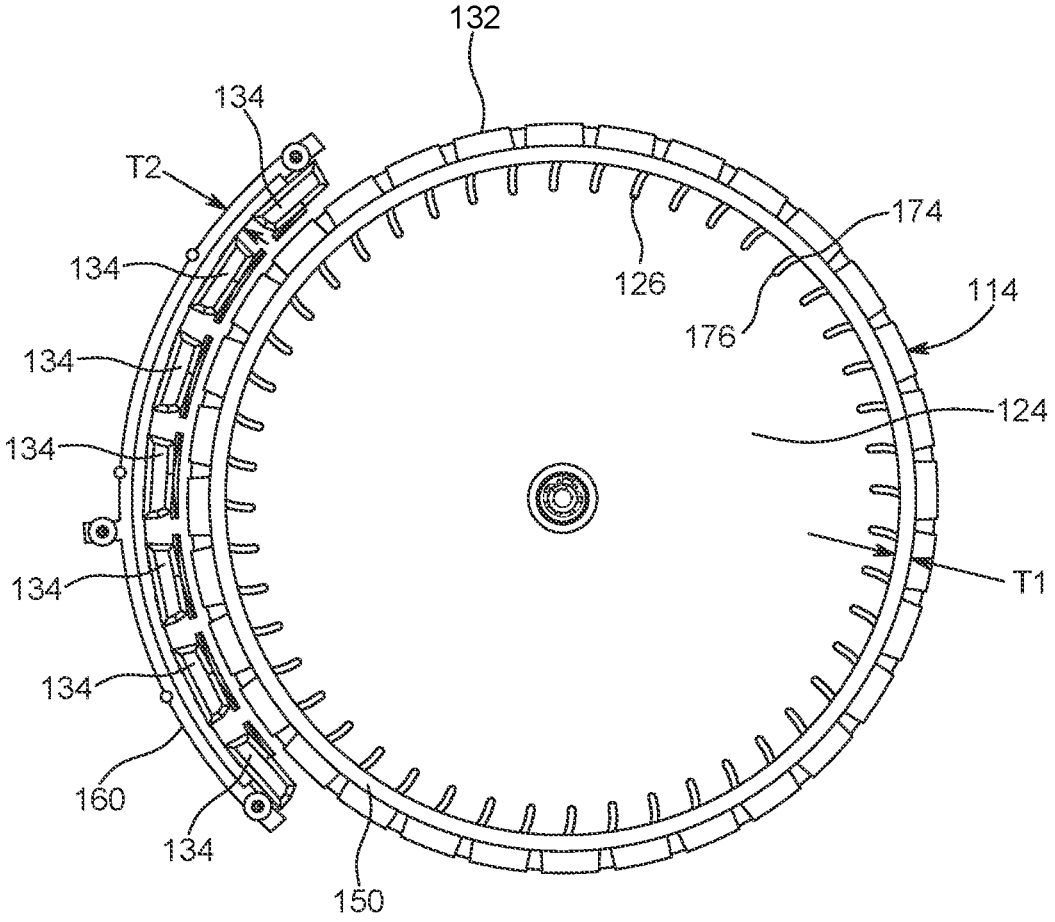
FIG. 8 is a top plan view of the fan wheel and rotation drive assembly of the ventilation fan of FIG. 3.
Figure 9:
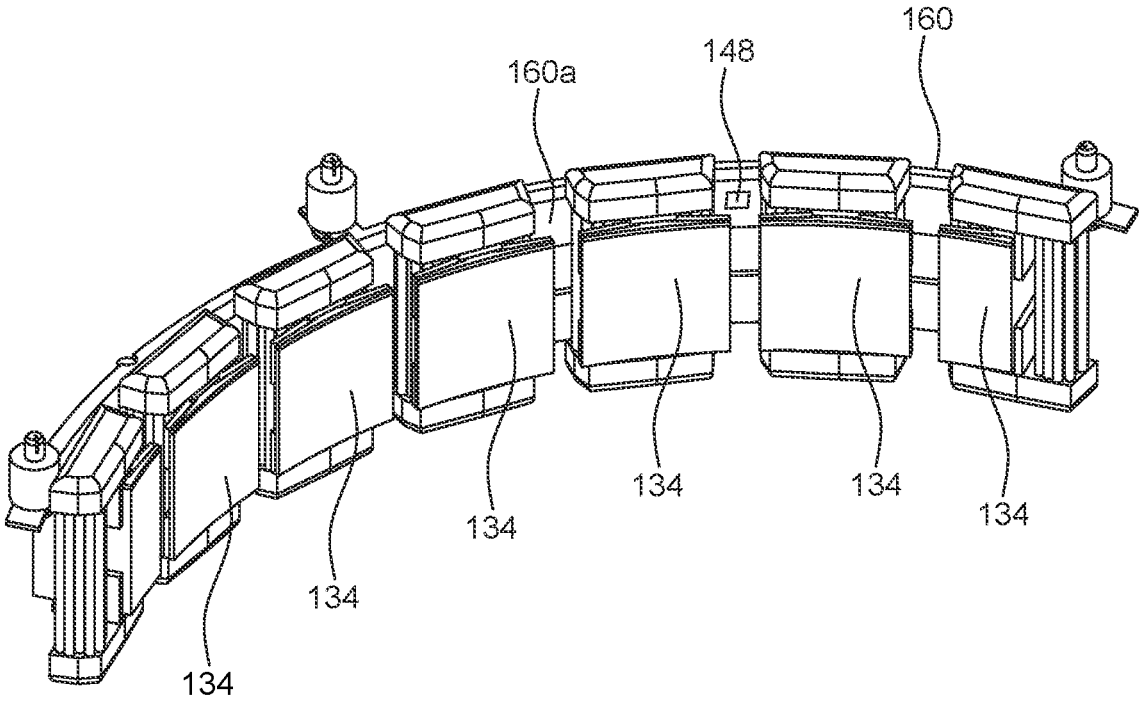
FIG. 9 is a perspective view of the stator magnets and stator magnet frame of the ventilation fan of FIG. 3.
Figure 10:
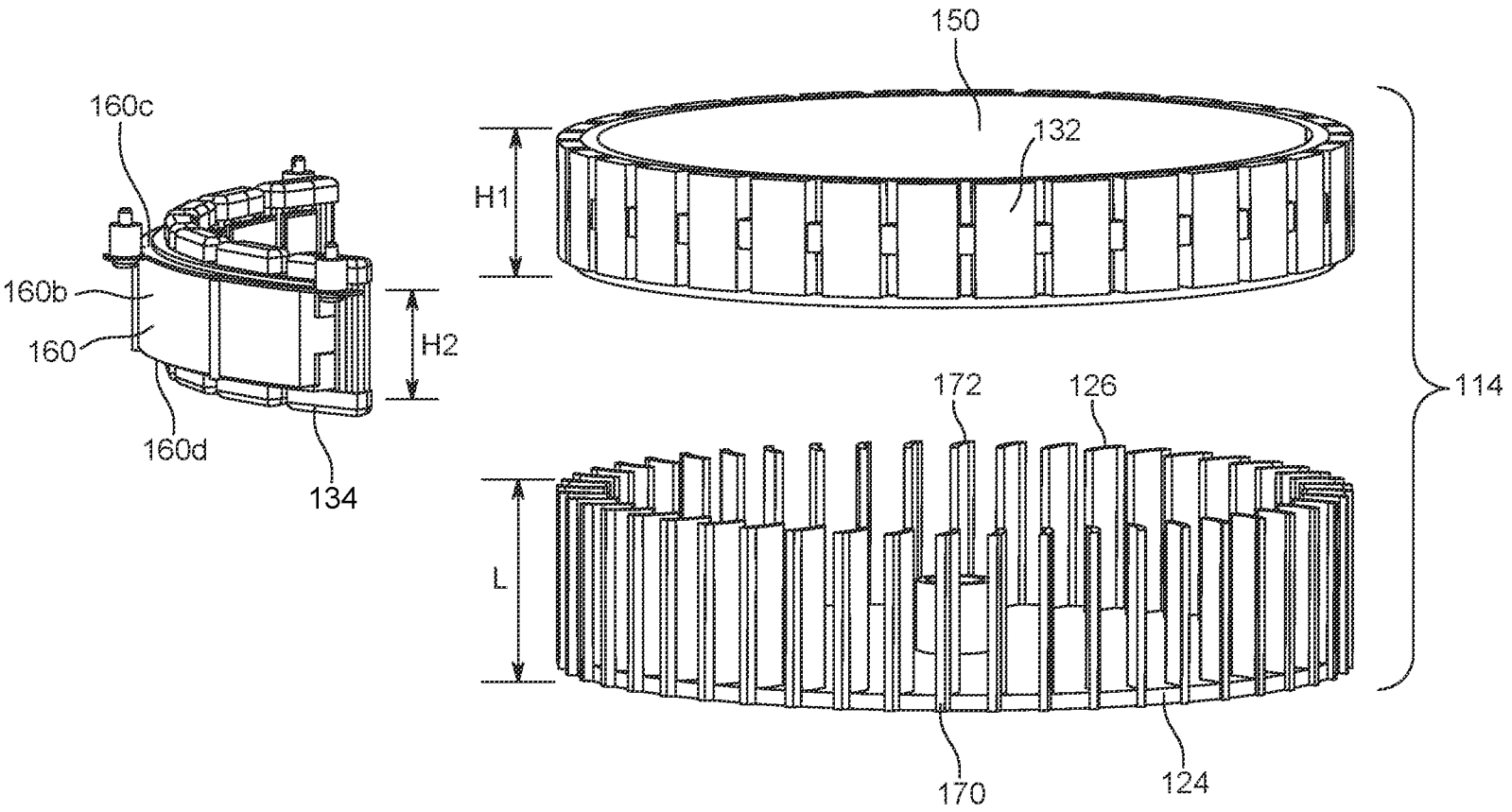
FIG. 10 is an exploded view of the fan wheel and rotation drive assembly of the ventilation fan of FIG. 3.
Figure 11:
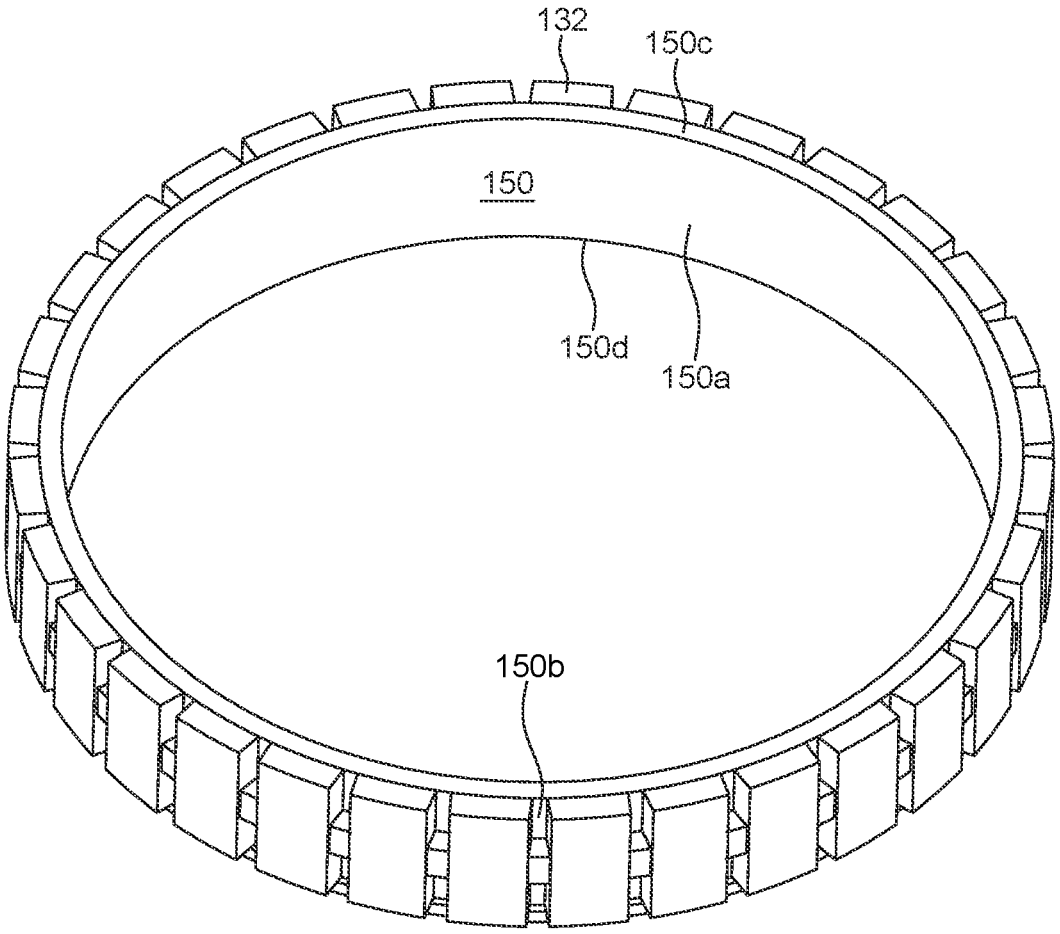
FIG. 11 is a perspective view of the rotor magnets and the rotor magnet support ring of the ventilation fan of FIG. 3.

As depicted, for example, in FIG. 8, the one or more stator magnets 134 are secured to the fan housing 112 by a stator magnet frame 160 that is secured to the fan housing 112. The stator magnet frame 160 defines an inner surface 160*a* and an outer surface 160*b*, defining a thickness T2 therebetween, as well as a top edge 160*c* separated from a bottom edge 160*d* to define a height H2 of the stator magnet frame 160 therebetween. In the depicted embodiment, the stator magnet frame inner surface 160*a* defines a uniform radius of curvature defined so that the stator magnets 134 will align with the rotor magnets 132 as desired to allow the stator magnets 134 to drive the rotor magnets 132 as dictated by the controller 136 and as discussed herein.

The one or more status magnets 134 are secured to the stator magnet frame 160 in any known manner. Likewise, the one or more rotor magnets 132 are secured to the support ring 150 in any known manner. The stator magnet frame 160 and the support ring 150 may be comprised any known materials, but preferably of a material and configuration that will minimize interferences with the magnetic fields of the rotor magnets 132 and the stator magnets 134.

In the depicted embodiment, the stator magnet frame 160 is sufficiently sized such that the one or more stator magnets 134 extend along approximately 90 degrees of rotation about the rotation axis 130. This sizing provides approximately 90 degrees of interface between the one or more rotor magnets 132 and the one or more stator magnets 134. Other embodiments provide greater or less degrees of interface between the one or more rotor magnets 132 and the one or more stator magnets 134. In other specific embodiment (not depicted), the stator magnet frame 160 extends to provide 180 degrees, 270 degrees or 360 degrees of interface between the one or more rotor magnets 132 and the one or more stator magnets 134. The stator magnet frame 160 can be comprised of a single piece of material or multiple pieces of material connected to each other or each independently connected to the fan housing 112.

The controller 136 includes a processor 142, a memory storage device 144, and a power source 146. The memory storage device 144 stores instructions that, when executed by the processor 142, cause the power source 146 to send electrical power to one or more of the stator magnets 134. The processor 142 is configured to synchronize when electrical power is supplied from the power source 146 to each of the stator magnets 134. A sensor 148 may be used to determine the location of the rotor magnets 132 relative to the stator magnets 134 and provide signals to the controller 136 so that the controller 136 may determine which of the stator magnets 134 to energize and when. The sensor 148 may be a Hall sensor or any other suitable sensor that is able to determine the location of the rotor magnets 132 relative to the stator magnets 134.

The invention claimed is:

1. A ventilation fan comprising:

a fan housing formed to define an interior space, an inlet opening, and an outlet opening spaced apart from the inlet opening, a fan wheel arranged to lie within the interior space, the fan wheel defining a rotational axis about which the fan wheel is configured to rotate, the fan wheel comprising a blade hub and a plurality of fan blades, each of the plurality of fan blades having a first end extending from the blade hub to a second end opposing the first end to define a fan blade length extending from the blade first end to the blade second end, wherein the fan blade length of the plurality of fan blades is oriented approximately parallel to the rotational axis, an inner edge and an opposing outer edge, wherein the inner edge is located closer to the rotational axis than the outer edge and the blade is configured to move air away from the rotational axis when the fan wheel is rotated about the rotational axis, a support ring secured to the second end of at least one fan blade of the plurality of fan blades, and a fan-wheel rotation drive assembly configured to rotate the plurality of fan blades about the rotational axis, the fan-wheel rotation drive assembly comprising one or more rotor magnets fixed to the support ring and arranged circumferentially around the rotational axis, and one or more stator magnets fixed to the fan housing and arranged circumferentially around the rotational axis.

2. The ventilation fan of claim 1 further comprising a controller coupled to each of the one or more stator magnets and configured to energize the one or more stator magnets and produce a magnetic field to cause magnetic interaction with at least one of the one or more rotor magnets so that the one or more rotor magnets and the plurality of fan blades rotate about the rotational axis.

3. The ventilation fan of claim 1 wherein the support ring defines (i) an inner surface and an outer surface defining a thickness T, and (ii) an top edge and a bottom edge defining a height H, and the fan blade second end of one or more of the fan blades lies along the height H of the support ring.

4. The ventilation fan of claim 3 wherein the fan blade second end of each of the fan blades lies along the height H of the support ring.

5. The ventilation fan of claim 3 wherein the support ring is secured to the second end of one of the one or more fan blades and extends further away from the hub from the fan blade second end.

6. The ventilation fan of claim 1 further comprising a stator magnet frame to which the one or more stator magnets are secured.

7. The ventilation fan of claim 6 wherein the stator magnet frame is secured to the fan housing.

8. The ventilation fan of claim 6 wherein the stator magnet frame extends about the rotor magnets on the fan wheel.

9. The ventilation fan of claim 8 wherein the stator magnet frame extends less than 360 degrees about the rotation axis.

10. The ventilation fan of claim 8 wherein the stator magnet frame extends 90 degrees about the rotation axis.

11. The ventilation fan of claim 8 wherein the stator magnet frame extends less than 360 degrees about the rotation axis.

12. The ventilation fan of claim 8 wherein the stator magnet frame extends 90 degrees about the rotation axis.

13. A ventilation fan comprising;

a fan housing defining an interior space;

at least one stator magnet connected to the fan housing;

a fan wheel located within the interior space, the fan wheel defining a rotational axis about which the fan wheel is configured to rotate, the fan wheel comprising a blade hub and a plurality of fan blades, each of the plurality of fan blades having a first end extending from the blade hub to a second end opposing the first end to define a fan blade length extending from the blade first end to the blade second end, wherein the fan blade length of the plurality of fan blades is oriented approximately parallel to the rotational axis, an inner edge and an opposing outer edge, wherein the inner edge is located closer to the rotational axis than the outer edge and the blade is configured to move air away from the rotational axis when the fan wheel is rotated about the rotational axis;

at least one rotor magnet secured to the second end of one or more of the plurality of fan blades connected to the fan wheel;

wherein at least one of the stator magnet and the rotor magnet is an electromagnet configured to produce a magnetic field to cause the other of the stator magnet and the rotor magnet to move.

14. The ventilation fan of claim 13 further comprising a stator magnet frame to which the at least one stator magnet is secured, wherein the stator magnet frame extends about the at least one rotor magnet on the fan wheel.

* * * * *